US007942246B2

(12) United States Patent
Saarikoski et al.

(10) Patent No.: US 7,942,246 B2
(45) Date of Patent: May 17, 2011

(54) CONTROLLING AN ELEVATOR WITH A STANDBY MODE

(75) Inventors: Tapio Saarikoski, Hyvinkää (FI); Jari Helvilä, Hyvinkää (FI); Risto Jokinen, Hyvinkää (FI)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 12/790,644

(22) Filed: May 28, 2010

(65) Prior Publication Data

US 2010/0258383 A1 Oct. 14, 2010

Related U.S. Application Data

(63) Continuation of application No. PCT/FI2008/000129, filed on Nov. 20, 2008.

(30) Foreign Application Priority Data

Nov. 30, 2007 (FI) ..... 20070924

(51) Int. Cl.
*B66B 1/06* (2006.01)

(52) U.S. Cl. ..... 187/290; 187/391

(58) Field of Classification Search ..... 187/247, 187/293, 296, 297, 290, 380–388, 391–393
See application file for complete search history.

(56) References Cited

U.S. PATENT DOCUMENTS

| | | | | |
|---|---|---|---|---|
| 6,446,760 | B1 * | 9/2002 | Lisi | 187/391 |
| 6,827,182 | B2 * | 12/2004 | Araki | 187/290 |
| 7,334,665 | B2 * | 2/2008 | Smith et al. | 187/247 |
| 7,392,883 | B2 * | 7/2008 | Hikita | 187/249 |
| 7,506,726 | B2 * | 3/2009 | Andrejak et al. | 187/290 |
| 7,575,102 | B2 * | 8/2009 | Matsuoka | 187/391 |
| 7,650,968 | B2 * | 1/2010 | Oesterle et al. | 187/290 |
| 7,681,694 | B2 * | 3/2010 | Aulanko et al. | 187/290 |
| 7,775,328 | B2 * | 8/2010 | Robledo Barrio et al. | 187/290 |
| 2003/0192746 | A1 * | 10/2003 | Suzuki | 187/391 |
| 2007/0295566 | A1 | 12/2007 | Lindegger | |

FOREIGN PATENT DOCUMENTS

| | | | |
|---|---|---|---|
| JP | 2001-2335 | A | 1/2001 |
| JP | 2004-244191 | A | 9/2004 |
| JP | 2005-212921 | A | 8/2005 |
| JP | 2006-36399 | A | 2/2006 |
| WO | WO 2005/092763 | A1 | 10/2005 |

* cited by examiner

*Primary Examiner* — Jonathan Salata
(74) *Attorney, Agent, or Firm* — Birch, Stewart, Kolasch & Birch, LLP

(57) ABSTRACT

An elevator system where control appliances of the elevator system are fitted to communicate between themselves is described herein. The elevator system has a control arrangement for placing at least one control appliance into standby mode or for terminating the standby mode. The control arrangement is fitted to set the standby mode on the basis of at least one activation signal, as well as to send a control signal of the standby mode to at least one control appliance of the elevator system. Associated methods for fitting a standby mode into an elevator system are also described herein.

9 Claims, 2 Drawing Sheets

CONTROLLING AN ELEVATOR WITH A STANDBY MODE

CROSS REFERENCE TO RELATED APPLICATIONS

Figure 1:
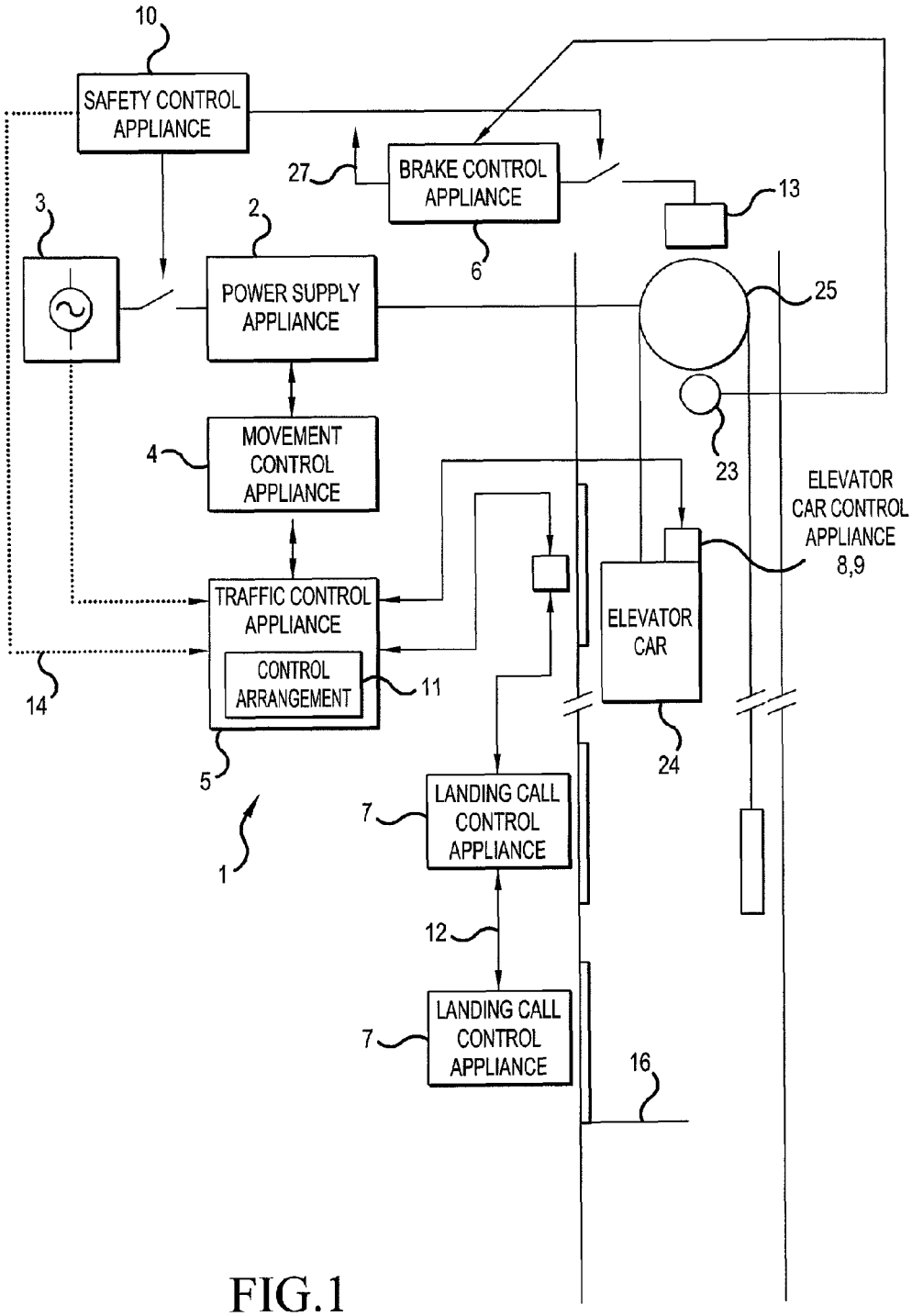

This application is a Continuation of PCT International Application No. PCT/FI2008/000129 filed on Nov. 20, 2008, which claims the benefit of Patent Application No. 20070924 filed in Finland, on Nov. 30, 2007. The entire contents of all of the above applications is hereby incorporated by reference.

FIELD OF THE INVENTION

The object of the invention is an elevator system as defined in the preamble of claim 1 and a method as defined in the preamble of claim 8.

PRIOR ART

The electricity supply during the standby mode of an elevator system is conventionally disconnected centrally at the control panel of the elevator, e.g. by extinguishing the power source of the elevator control electronics. The aim of disconnecting the electricity supply is to reduce the power losses of the elevator system.

Publication JP2005162441 presents a power source of elevator control electronics, which can be extinguished in a controlled manner by means of a special extinguishing circuit.

Publication JP2003054846 presents an arrangement for the standby mode of an elevator, in which the control panel of the elevator comprises means for disconnecting the power supply of the cards of the landing door.

Publication JP2005212921 presents an elevator control arrangement, which comprises a switch for disconnecting the power supply both from the control electronics as well as from the main circuit of the power supply appliance of the motor.

PURPOSE OF THE INVENTION

The purpose of the invention is to disclose a standby mode arrangement of an elevator, which arrangement is more versatile than prior art and by means of which one or more control appliances of the elevator can be controlled to standby mode or to terminate the set standby mode either simultaneously or in stages. In this case the standby mode can be determined more diversely than in prior art by means of different activation signals, and on the basis of the determination it is also possible to select the appliances to control into standby mode as well as the duration of the standby mode. The time of recovery from standby mode can in this case vary according to the requirements of the control situation of the elevator.

CHARACTERISTIC FEATURES OF THE INVENTION

The elevator system according to the invention is characterized by what is disclosed in the characterization part of claim 1. The method according to the invention for fitting a standby mode into an elevator is characterized by what is disclosed in the characterization part of claim 8. Other features of the invention are characterized by what is disclosed in the other claims. Some inventive embodiments are also discussed in the descriptive section of the present application.

The inventive content of the application can also be defined differently than in the claims presented below. The inventive content may also consist of several separate inventions, especially if the invention is considered in the light of expressions or implicit sub-tasks or from the point of view of advantages or categories of advantages achieved. In this case, some of the attributes contained in the claims below may be superfluous from the point of view of separate inventive concepts.

The elevator system according to the invention comprises control appliances of the elevator system that are fitted to communicate between themselves. The elevator system comprises a control arrangement for placing at least one control appliance of the elevator system into standby mode or for terminating the standby mode. The aforementioned control arrangement is fitted to set a standby mode on the basis of at least one activation signal, and the control arrangement is fitted to sent a control signal of the standby mode to at least one control appliance of the elevator system, which control appliance of the elevator system comprises a first and a second power supply circuit. A controllable switch is connected to the aforementioned second power supply circuit such that power supply from the output of the second power supply circuit can be either allowed or prevented with the control of the switch.

A controller is connected to the aforementioned first power supply circuit, which controller comprises an input for the control signal of the standby mode, and the aforementioned controller is fitted to control the aforementioned switch on the basis of the control signal of the standby mode.

In one embodiment of the invention the control signal of the standby mode comprises individualized data of the control appliance of the elevator system to be controlled into the standby mode, and the control information contained in the control signal can in this case possibly also vary depending on what control appliance of the elevator system the control signal of the standby mode applies to.

One elevator system according to the invention comprises at least one of the following control appliances: a traffic control appliance, a movement control appliance, a power control appliance of the elevator motor, a control appliance of the lighting of the elevator, a control appliance of the landing calls, a control appliance of the elevator car, a brake control appliance of the elevator and also a control appliance of the safety arrangement of the elevator.

In one arrangement according to the invention at least one of the following functions as an activation signal: a landing call signal, a status signal of the control appliance of the safety arrangement of the elevator, a movement signal of the elevator car, a status signal of the power supply of the elevator, a signal of the sensor of the stopping floor of the elevator.

In one elevator system according to the invention at least one control appliance of the elevator system is fitted to switch to standby mode after the elevator car has stopped at the stopping floor of the elevator.

In one elevator system according to the invention at least one control appliance of the elevator system comprises a first and a second power supply circuit. In this case a controllable switch is connected to the second power supply circuit such that power supply from the output of the second power supply circuit can be either allowed or prevented with the control of the switch. In this embodiment of the invention a controller is connected to the first power supply circuit, which controller comprises an input for the control signal of the standby mode as well as an output for the control signal of the aforementioned controllable switch, and the aforementioned controller is fitted to control the aforementioned switch on the basis of the control signal of the standby mode. The aforementioned controlled switch can be a mechanical switch, such as a relay or contactor, or the switch can also be a semiconductor, such as an IGBT transistor, a MOSFET transistor, or a thyristor.

In one elevator system according to the invention the power supply circuit of the sensor that measures the movement of the elevator car is in the output of the second brake power supply circuit, and in the standby mode of the control appliance of the elevator the aforementioned controllable switch is periodically controlled to the state of permitted power supply for reading the sensor that measures the movement of the elevator car one preset interval at a time.

In one elevator system according to the invention the power supply to the brake of the elevator is fitted to occur with the control of the brake control appliance of the elevator via the power supply circuit of the safety devices of the elevator.

The aforementioned controllable switch is in this case fitted to the power supply circuit of the brake of the elevator such that power supply to the opener of the brake can be either allowed or prevented with the control of the switch, and in the standby mode of the brake control appliance the aforementioned switch is periodically controlled to the state of permitted power supply of the elevator for testing the brake of the elevator one preset interval at a time. The aforementioned brake opener can be e.g. a coil of the magnetic circuit of the brake.

One control appliance of the safety arrangement of an elevator according to the invention comprises the safety devices of the elevator, such as the control of the power supply of the sensors measuring the safety of the elevator. In one elevator system according to the invention the control appliance of the safety arrangement of the elevator is fitted it in its standby mode to periodically supply power to at least one sensor that measures the safety of the elevator for reading the aforementioned sensor one preset measurement interval at a time. The control appliance of the safety arrangement of the elevator can be implemented with electronic circuits, such as with one or two microcontrollers that monitor each other, or the control appliance can also be implemented with e.g. relays.

In one elevator system according to the invention the lighting of the elevator is controlled on the basis of a control signal of the standby mode received by the control appliance of the lighting of the elevator.

The standby mode of the control appliance of one elevator system according to the invention is divided between a first and a second standby mode. The aforementioned control appliance is in this case fitted to switch to a first standby mode with a first delay after receiving the control signal of the standby mode. After switching to the first standby mode the aforementioned control appliance is fitted to further switch after a preset second time delay to a second standby mode. In the second standby mode the functions of the control appliance are further extinguished, and recovery from the second standby mode is in this case slower than recovery from the first standby mode. For example, the power control appliance of the elevator motor, such as a frequency converter, can be fitted to extinguish its control electronics, such as the control electronics of the power semiconductors, in the first standby mode, and the frequency converter can in this case be fitted to further extinguish its DC intermediate circuit in the second standby mode, in which case recovery from the second standby mode requires recharging of the capacitors of the DC intermediate circuit.

In the method according to the invention for fitting a standby mode into an elevator system, control appliances that communicate between themselves are fitted into the elevator system, and at least one aforementioned control appliance of the elevator system is controlled into standby mode or the standby mode of at least one control appliance of the elevator system is terminated. In the method the standby mode of the elevator is set on the basis of at least one activation signal; a control signal of the standby mode is sent to at least one control appliance of the elevator system; a first and a second power supply circuit are fitted to the control appliance of the elevator system; a controllable switch is connected to the second power supply circuit such that power supply from the output of the second power supply circuit can be either allowed or prevented with the control of the switch; a controller is fitted to the first power supply circuit; and also an input for the control signal of the standby mode is fitted in connection with the controller; and the control signal of the standby mode is read and the switch is controlled with the controller on the basis of the control signal of the standby mode.

In one method according to the invention the control signal of the standby mode is sent to at least one control appliance of the elevator system.

In one method according to the invention a first and a second power supply circuit are fitted to a control appliance of the elevator system; a controllable switch is connected to the second power supply circuit such that power supply from the output of the second power supply circuit can be either allowed or prevented with the control of the switch; a controller is fitted to the first power supply circuit; and also an input for the control signal of the standby mode and an output for the control signal of the switch is fitted in connection with the controller; and the control signal of the standby mode is read with the switch and also the switch is controlled on the basis of the control signal of the standby mode.

In one method according to the invention the power supply of the sensor that measures movement of the elevator car is fitted to the output of the second power supply circuit; the control signal of the standby mode is read, and the controller is switched to standby mode according to the control signal read; in the standby mode the switch is periodically controlled to the mode permitting power supply for at least one preset interval at a time; and also the sensor that measures movement of the elevator car is read during the permitted power supply mode of the switch.

One determination of the standby mode according to the invention on the basis of at least one activation signal is integrated into a control appliance of the elevator system.

In one embodiment of the invention at least two control appliances of the elevator system are integrated at least partly with each other, e.g. on the same circuit board.

In one embodiment of the invention the aforementioned controllable switch connected to the second power supply circuit is controlled during the power supply permitting mode of the aforementioned switch with switching frequency modulation, such as with prior-art PWM modulation (pulse width modulation).

ADVANTAGES OF THE INVENTION

With the invention at least one of the following advantages, among others, is achieved:

When the standby mode of the elevator system is determined with the control arrangement on the basis of one or more activation signals, and on the basis of the determination a control signal of the standby mode is sent to at least one control appliance of the elevator system, the standby mode of one or more control appliances of the elevator system can be controlled in a controlled manner, in which case it is possible on the basis of the determination to separately select the appliances to be controlled into standby mode. In addition, the duration of the standby mode of different appliances can differ from each other. It is further possible to control those control appliances whose recovery from standby mode is quick after a first short time delay, and to also control other devices whose recovery from standby mode is slower after a longer time delay. In this case e.g. recovery from a standby mode during heavy traffic in the daytime can be quicker than, for instance, at night when there is less traffic. In addition, different activation signals can affect the selection of the elevator system control appliances to be controlled, as well as e.g. the duration of the standby mode.

The elevator system can be switched to standby mode e.g. in the situation when the set time from the last landing call has passed. On the other hand, the standby mode can be terminated when a new landing call is registered.

When a control appliance of the safety arrangement of the elevator detects that safety is endangered, the control appliance of the safety arrangement can send information about this in its status signal to the control arrangement of the standby mode, and the standby mode can be terminated on the basis of the aforementioned status signal. In this case the standby mode can be terminated e.g. in the situation when the control appliance of the safety arrangement has detected that the landing door of the elevator has opened to the elevator shaft.

The standby mode can be terminated e.g. if moving of the elevator car is detected. This movement information can be read e.g. from a movement signal of the elevator car, such as a signal of the elevator motor or of the encoder of the car roof or of the acceleration sensor.

The elevator system can be brought into a standby mode in the situation when it is detected from the status signal of the power supply of the elevator that the power supply of the elevator, e.g. the network voltage supply, is disconnected. During this so-called battery backup the sensors that are important from the standpoint of the safety of the elevator can also be read periodically, in which case operating power is supplied to the sensors only intermittently, which of course reduces the current consumption of the elevator system.

It is possible to determine the stopping of the elevator car in the floor zone from the signal of the sensor of the stopping floor of the elevator, e.g. from the signal of an ultrasound sensor fitted to the stopping floor, of a hall sensor or magnetic switch reading a permanent magnet fitted to the stopping floor. If the aforementioned floor zone is set as a safe stopping zone for the elevator car, at least one control appliance of the elevator system, e.g. the power supply appliance of the elevator motor, can be controlled into standby mode.

If a first and a second power supply circuit is fitted to at least one control appliance of the elevator system such that the power supply from the output of the second power supply circuit can be either allowed or prevented with the control of the controllable switch, the second power supply circuit can extinguish as presented in the invention for the duration of the standby mode, in which case the current consumption of the aforementioned control appliance and at the same time of the whole elevator system decreases. Control electronics of a control device can also if necessary be fitted to the first and the second power supply circuit such that the first power supply circuit comprises only a controller, such as a small microcontroller with low current consumption, as well as the interface electronics of the inputs and outputs for the activation signals and control signals. In this case the components that consume most current, such as the power-consuming resistors and other passive components, can be disposed in the second power supply circuit. In this case also each aforementioned control appliance of the elevator system can if necessary can be brought into standby mode independently and irrespective of the other aforementioned control appliances.

When the power supply of the sensor that measures movement of the elevator car is taken from the output of the second power supply circuit, it is possible in the standby mode of the elevator to supply power only periodically and at the set time that is needed to read the sensor. The sensor can in this case be read e.g. with a controller fitted to the first power supply circuit.

When the aforementioned controllable switch is fitted to the power supply circuit of the brake of the elevator such that the power supply to the opener of the brake is either allowed or prevented with the control of the switch, it is possible to supply power to the aforementioned opener of the brake, such as to the coil of the machinery brake, in a standby mode of the brake control appliance only in the situation when the brake is tested. For example testing of the machinery brake of the elevator is performed just a few times a day. In this case the machinery brakes of the elevator machine are opened one at a time, and movement of the elevator car is monitored from the movement signal of the elevator car.

When power is supplied with the control appliance of the safety arrangement in the standby mode of the elevator system to the sensors measuring the safety of the elevator, e.g. to the sensors of the landing door, periodically only for the time interval needed for measurement, the current consumption of the elevator system decreases, and in this case it is possible also e.g. during battery backup to measure, for instance, the position of the landing doors and to detect e.g. the unauthorized movement of a person into the elevator shaft. In this case the safety of the elevator system improves when comparing it to e.g. prior-art elevator systems in which the current supply of the safety circuit of the sensors of the landing door is disconnected completely when the power supply of the elevator is disconnected.

PRESENTATION OF DRAWINGS

In the following, the invention will be described in more detail by the aid of a few examples of its embodiments with reference to the attached drawings, wherein FIG. 1 presents an elevator system, into which a control arrangement according to the invention is fitted.

Figure 2:
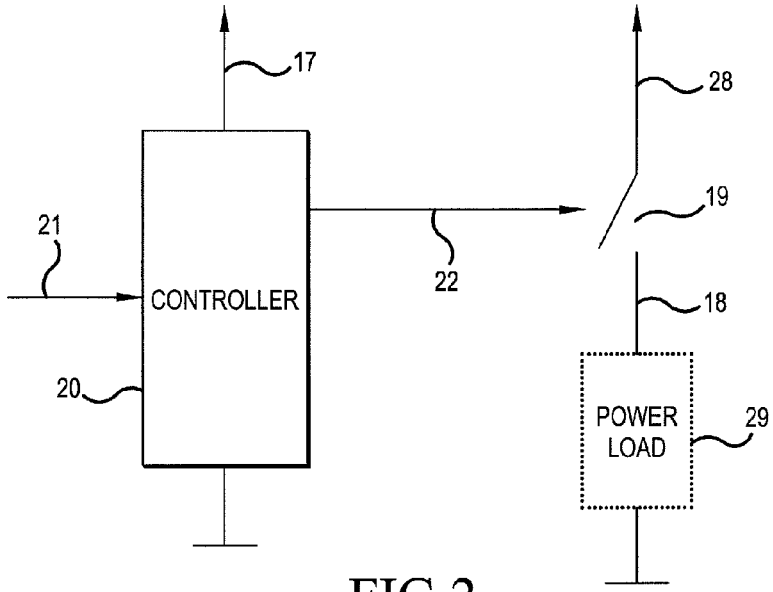

FIG. 2 presents a control appliance according to the invention.

Figure 3:
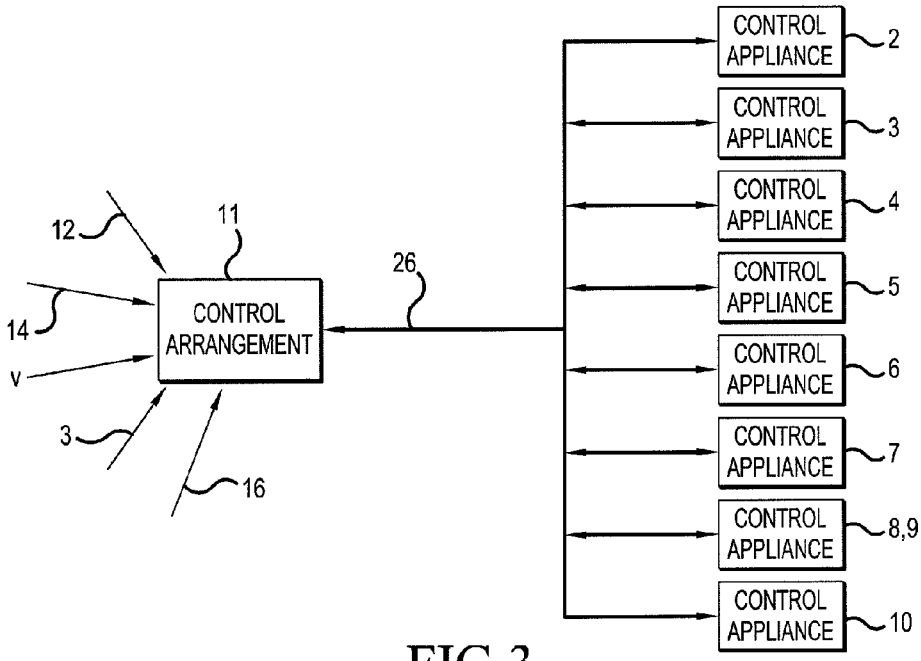

FIG. 3 presents a control arrangement according to the invention.

EMBODIMENTS

FIG. 1 presents an elevator system, into which a control arrangement is fitted for placing at least one control appliance 2,3,4,5,6,7,8,9,10 of the elevator system into standby mode or for terminating a standby mode. A serial bus 26 is between the control appliances of the elevator system, via which bus the control appliances communicate with each other. The elevator car 24 is moved in the elevator shaft via ropes connected to the traction sheave 25 of the elevator motor. The power supply of the elevator motor occurs with a power supply appliance 2 of the elevator motor, which is here a frequency converter between the power source 3 and the elevator motor. The power supply and thus also the movement of the elevator car 24 is regulated with the movement control appliance 4 of the elevator system that is integrated into the frequency converter. The traffic control appliance 5 of the elevator system takes care of regulating the traffic of the elevator system, such as the allocation of landing calls. The control appliances 7 of the landing calls transmit landing calls to the traffic control appliance 5. The control appliance 9 of the elevator car comprises a control of the door of the elevator car, a control of the car calls as well as a measurement of the movement of the elevator car with an acceleration sensor. The control appliance 8 of the lighting supervises the regulation of the lighting of the elevator car. The brake control appliance 6 of the elevator supplies power to the coil of the machinery brake with the control of the control unit of the brake control appliance. The power supply to the coil of the machinery brake takes place from the power supply circuit 27 of the safety devices of the elevator. The power supply to the power supply circuit of the safety devices can also be disconnected with the control appliance 10 of the safety arrangement of the elevator. The control appliance 10 of the safety arrangement reads the sensors that measure the safety of the elevator, such as the safety switches of the landing door of the elevator or of the car door, the end limit switches of the elevator shaft or the movement signals of the elevator car. If it detects that safety is endangered, the control appliance 10 controls the machinery brake 13 of the elevator and also if necessary the wedge brake, i.e. the safety gear (not shown in the figure) of the elevator car. In addition the control appliance 10 of the safety arrangement prevents power supply from the power source 3 to the elevator motor by opening the power supply circuit with controllable switches.

The control arrangement 11 for placing at least one control appliance of the elevator system into standby mode or for terminating the standby mode is integrated into the traffic control appliance 5 of the elevator system. The control arrangement 11 determines the standby mode on the basis of the activation signals. The control arrangement measures the time that has passed from the latest landing call signal 12, and after a set time delay the control arrangement sets switching to the standby mode of the elevator system. In this case the control arrangement sends a control signal 21 of the standby mode to the control appliances 2,3,4,5,6,7,8,9,10 of the elevator system via the serial bus between the control appliances. If it detects a new landing call signal 12 the control arrangement 11 sends a control signal 21 of the standby mode to the control appliances of the elevator system to terminate the standby mode. The control arrangement also reads the status signal 14 of the control appliance 10 of the safety arrangement of the elevator, and on the basis of the status signal sets a standby mode to be terminated e.g. when a landing door opens into the elevator shaft. When the control arrangement 11 detects the adequate duration of the presence of the elevator car 24 in the stopping zone on the basis of the signal of the sensor 16 of the stopping floor of the elevator, the control arrangement deduces that the elevator car has stopped at the floor. In this case the control arrangement sets the standby mode, and sends the control signal of the standby mode to the frequency converter 2 as well as to the traffic control appliance 4, in which case the frequency converter as well as the traffic control appliance switch to standby mode while the elevator car stands at the floor.

Dropping of the network supply voltage of the elevator system is detected from the status signal of the power supply 3 of the elevator. In this case the control arrangement sets the standby mode on the basis of the status signal, and sends the control signal 21 of the standby mode to the control appliances of the elevator system. Since the power supply of the whole elevator system occurs from the battery backup when the network voltage 3 has disconnected, the control appliances 2,3,4,5,6,7,8,9,10 of the elevator system are controlled as comprehensively as possible to standby mode in order to reduce the current consumption. When the elevator car is standing at the floor during standby mode, the movement status of the elevator car is determined on the basis of the signal of the sensor 16 of the stopping floor of the elevator. Otherwise the movement status of the elevator car is periodically measured during the standby mode with the encoder connected to the traction sheave 25 of the elevator motor such that approx. once a second power is supplied to the encoder for a period of approx. 10-50 milliseconds, which time is needed to read the sensor. The measured speed is also presented with a separate display appliance. During battery backup mode the control appliance 10 of the safety arrangement of the elevator supplies power periodically to the sensors that measure the safety of the elevator once a second for a period of 10-50 milliseconds, which time is needed to read these sensors. In this case the control appliance 10 of the safety arrangement can on the basis of the aforementioned sensors, such as the safety switches of the landing door, monitor the safety of the elevator system also in the battery backup mode.

In the standby mode a brake test of the machinery brakes of the elevator is performed with the brake control appliance 6 a few times per 24-hour period. In this case power is supplied with the brake control appliance to one of two machinery brakes of the elevator at a time, and the movement status of the elevator car is measured with the encoder 23.

If it is detected in the measurements made during the standby mode that the safety of the elevator car has been endangered, the elevator system is switched to a mode in which drive with the elevator is prevented, and if necessary fault data is sent to the remote monitoring system of the elevator.

FIG. 2 presents a control appliance 2,3,4,5,6,7,8,9,10 of an elevator system. The first 17 and the second 18, 28 power supply circuit are fitted into the control appliance. The power load 29 is connected to the output 18 of the second power supply circuit. A controllable switch 19 is connected between the input 28 and the output 18 of the second power supply circuit such that power supply from the output 18 of the second power supply circuit can be either allowed or prevented with the control of the switch 19. A controller 20 is connected to the first power supply circuit 17, which controller comprises an input for the control signal 21 of the standby mode and also an output for the control signal 22 of the aforementioned controllable switch. The controller 20 is fitted to control the switch 19 on the basis of the control signal 21 of the standby mode such that power supply to the power load 29 is permitted when the switch 19 is conducting, and power supply to the power load 29 is prevented when the switch 19 is open, in which case the power consumption of the control appliances 2,3,4,5,6,7,8,9,10 of the elevator system decreases.

FIG. 3 presents a control arrangement 11 for placing at least one control appliance 2,3,4,5,6,7,8,9,10 of the elevator system into standby mode or for terminating a standby mode. The control arrangement 11 reads the activation signals, such as the landing call signal 12, the status signal 13 of the control appliance of the safety arrangement of the elevator, the speed signal v of the elevator car, the status signal of the power supply 3 of the elevator and also the signal of the sensor 16 of the stopping floor of the elevator. On the basis of the control signals read the control arrangement 11 sends if necessary a control signal 21 of the standby mode to the control appliances 2,3,4,5,6,7,8,9,10 of the elevator system via the serial bus 26 between them.

The invention is described above by the aid of a few examples of its embodiment. It is obvious to the person skilled in the art that the invention is not limited to the embodiments described above, but that many other applications are possible within the scope of the inventive concept defined by the claims presented below.

The controller 20 of standby mode as well as the controllable switch 19 can be separate components to each other, or they can be integrated into the same control component. The aforementioned controller 20 can also be implemented e.g. with a microcontroller.

The invention claimed is:

1. Elevator system, which comprises control appliances of the elevator system fitted to communicate between themselves, and which elevator system comprises a control arrangement for placing at least one control appliance of the elevator system into a standby mode or for terminating a standby mode, wherein the aforementioned control arrangement is fitted to set the standby mode on the basis of at least one activation signal, and in that the control arrangement is fitted to send a control signal of the standby mode to at least one control appliance of the elevator system, which control appliance of the elevator system comprises a first and a second power supply circuit, to which second power supply circuit a controllable switch is connected such that power supply from the output of the second power supply circuit can be either allowed or prevented with the control of the switch, and to which first power supply circuit a controller is connected, which controller comprises an input for the control signal of the standby mode, and in that the aforementioned controller is fitted to control the aforementioned switch on the basis of the control signal of the standby mode.

2. Elevator system according to claim 1, wherein at least one of the following functions as the activation signal:

the landing call signal the status signal of the control appliance of the safety arrangement of the elevator the movement signal of the elevator car the status signal of the power supply of the elevator the signal of the sensor of the stopping floor of the elevator.

3. Elevator system according to any of the preceding claims, wherein at least one control appliance of the elevator system is fitted to switch to standby mode after the elevator car has stopped at the stopping floor of the elevator.

4. Elevator system according to claim 1, wherein the power supply of the sensor that measures the movement of the elevator car is in the output of the second brake power supply circuit, and in that the aforementioned controllable switch is periodically controlled to the mode of permitted power supply in the standby mode of the control appliance of the elevator for reading the sensor that measures the movement of the elevator car one preset interval at a time.

5. Elevator system according to claim 1, wherein the power supply to the brake of the elevator is fitted to occur with the control of the brake control appliance of the elevator via the power supply circuit of the safety devices of the elevator, the aforementioned controllable switch is fitted to the power supply circuit of the brake of the elevator such that power supply to the opener of the brake can be either allowed or prevented with the control of the switch, and in that the aforementioned switch is periodically controlled to the state of permitted power supply in the standby mode of the brake control appliance of the elevator for testing the brake of the elevator one preset interval at a time.

6. Elevator system according to claim 1, wherein the lighting of the elevator is controlled on the basis of a control signal of the standby mode received by the control appliance of the lighting of the elevator.

7. Elevator system according to claim 1, wherein the control appliance of the safety arrangement of the elevator is fitted to periodically supply power in its standby mode to at least one sensor that measures the safety of the elevator for reading the aforementioned sensor one preset interval at a time.

8. Method for fitting a standby mode in an elevator system, in which method control appliances that communicate between themselves are fitted to the elevator system, and at least one aforementioned control appliance of the elevator system is controlled into standby mode or the standby mode of at least one control appliance of the elevator system is terminated, wherein:

the standby mode of the elevator is determined on the basis of at least one activation signal, and a control signal of the standby mode is sent to at least one control appliance of the elevator system a first and a second power supply circuit are fitted to the control appliance of the elevator system a controllable switch is connected to the second power supply circuit such that power supply from the output of the second power supply circuit can be either allowed or prevented with the control of the switch a controller is fitted to the first power supply circuit, and also an input for the control signal of the standby mode is fitted in connection with the controller the control signal of the standby mode is read, and the switch is controlled with the controller on the basis of the control signal.

9. Method according to claim 8, wherein:

a sensor that measures the movement of the elevator car is fitted to the output of the second power supply circuit the control signal of the standby mode is read and the controller is switched to standby mode according to the control signal read, in the standby mode the switch is periodically controlled to the mode permitting power supply for at least one preset interval at a time, and the sensor that measures the movement of the elevator car is read during the permitted power supply mode of the switch.

* * * * *